US007937875B1

(12) United States Patent
Berg

(10) Patent No.: US 7,937,875 B1
(45) Date of Patent: May 10, 2011

(54) ADJUSTABLE FIREARM GRIP

(76) Inventor: David J. Berg, Brandon, SD (US)

( * ) Notice: Subject to any disclaimer, the term of this patent is extended or adjusted under 35 U.S.C. 154(b) by 15 days.

(21) Appl. No.: 12/551,014

(22) Filed: Aug. 31, 2009

(51) Int. Cl.
*F41C 23/12* (2006.01)

(52) U.S. Cl. ..... 42/72; 42/71.01; 42/94; 89/1.42

(58) Field of Classification Search ..... 42/71.01, 42/71.02, 72, 94; 89/1.42
See application file for complete search history.

(56) References Cited

U.S. PATENT DOCUMENTS

| | | | | |
|---|---|---|---|---|
| 445,192 | A | 1/1891 | Nye et al. | |
| 1,585,249 | A | 5/1926 | Johns | |
| 2,771,697 | A | 11/1956 | Reising | |
| 2,826,848 | A | 3/1958 | Davies | |
| 3,164,920 | A * | 1/1965 | Haas, Jr. et al. | 42/71.01 |
| 4,198,638 | A * | 4/1980 | Carolus | 343/715 |
| 4,876,814 | A * | 10/1989 | Lombardo | 42/94 |
| 5,018,294 | A * | 5/1991 | McGuffee | 42/94 |
| 5,048,215 | A | 9/1991 | Davis | |
| 5,402,595 | A * | 4/1995 | Tamllos | 42/94 |
| 5,414,949 | A * | 5/1995 | Peebles | 42/94 |
| 5,417,002 | A | 5/1995 | Guerra | |
| 5,903,995 | A * | 5/1999 | Brubach | 42/94 |
| 5,930,931 | A * | 8/1999 | Watson | 42/94 |
| 6,397,507 | B1 * | 6/2002 | Marshall et al. | 42/72 |
| 6,658,781 | B1 | 12/2003 | Bowen | |
| 6,920,713 | B1 * | 7/2005 | Love | 42/94 |
| 7,243,455 | B2 * | 7/2007 | Jurk | 42/94 |
| 7,380,486 | B1 * | 6/2008 | Bean | 89/37.04 |
| 7,454,858 | B2 * | 11/2008 | Griffin | 42/71.01 |
| 7,500,328 | B1 * | 3/2009 | Bean | 42/94 |
| 7,506,470 | B2 * | 3/2009 | Pereksta | 42/94 |
| 7,578,089 | B1 * | 8/2009 | Griffin | 42/71.01 |
| 7,654,498 | B1 * | 2/2010 | Beltz | 248/351 |
| 7,698,847 | B2 * | 4/2010 | Griffin | 42/71.01 |
| 2006/0191183 | A1 * | 8/2006 | Griffin | 42/72 |
| 2007/0068056 | A1 * | 3/2007 | Jurk | 42/94 |
| 2007/0261287 | A1 * | 11/2007 | Hunt et al. | 42/94 |
| 2007/0271832 | A1 * | 11/2007 | Griffin | 42/72 |
| 2008/0086928 | A1 * | 4/2008 | Pereksta | 42/94 |
| 2009/0049731 | A1 * | 2/2009 | Seuk | 42/94 |
| 2009/0223105 | A1 * | 9/2009 | Griffin | 42/72 |
| 2009/0313874 | A1 * | 12/2009 | Griffin | 42/72 |

* cited by examiner

*Primary Examiner* — Benjamin P Lee
(74) *Attorney, Agent, or Firm* — Neustel Law Offices

(57) ABSTRACT

An adjustable firearm grip which is adaptable for use on a wide range of firearm types and barrel sizes. The adjustable firearm grip generally includes a handgrip including an upper opening and a lower opening. A passageway extends from the upper opening to the lower opening and includes a connector slidably positioned therein. A strap is provided for extending around a firearm, wherein both ends of the strap are each connected to the connector and the strap extends upwardly from the upper opening of the handgrip. A strap bolt and adjustment knob are threadably attached to the connector. The adjustable firearm grip may be attached to a firearm by placing the strap around the firearm's barrel at any location and then turning the adjustment knob to tighten the strap for a firm fit.

19 Claims, 8 Drawing Sheets

ADJUSTABLE FIREARM GRIP

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a firearm grips and more specifically it relates to an adjustable firearm grip which is adaptable for use on a wide range of firearm types and barrel sizes.

2. Description of the Related Art

Any discussion of the related art throughout the specification should in no way be considered as an admission that such related art is widely known or forms part of common general knowledge in the field.

Firearm grips have been in use for years. A firearm grip generally extends downwardly from the barrel or stock of a firearm to provide a handgrip to an individual using the firearm. Typically, a firearm grip is integrally formed or non-adjustably attached to a firearm in a way that prevents variation to accommodate the needs of different individuals.

Removable firearm grips are generally designed to accommodate only specific types of firearms and barrel sizes, thus preventing the use of a single firearm grip on a variety of firearm types. Existing firearm grips are also generally complex in design and difficult to attach and remove on the fly. Because of the inherent problems with the related art, there is a need for a new and improved adjustable firearm grip which is adaptable for use on a wide range of firearm types and barrel sizes.

BRIEF SUMMARY OF THE INVENTION

A general purpose of the present invention is to provide an adjustable firearm grip which is adaptable for use on a wide range of firearm types and barrel sizes. The invention generally relates to an adjustable firearm grip which includes a handgrip including an upper opening and a lower opening A passageway extends from the upper opening to the lower opening and includes a connector slidably positioned therein. A strap is provided for extending around a firearm, wherein both ends of the strap are each connected to the connector and the strap extends upwardly from the upper opening of the handgrip. A strap bolt and adjustment knob are threadably attached to the connector. The adjustable firearm grip may be attached to a firearm by placing the strap around the firearm's barrel at any location and then turning the adjustment knob to tighten the strap for a firm fit.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
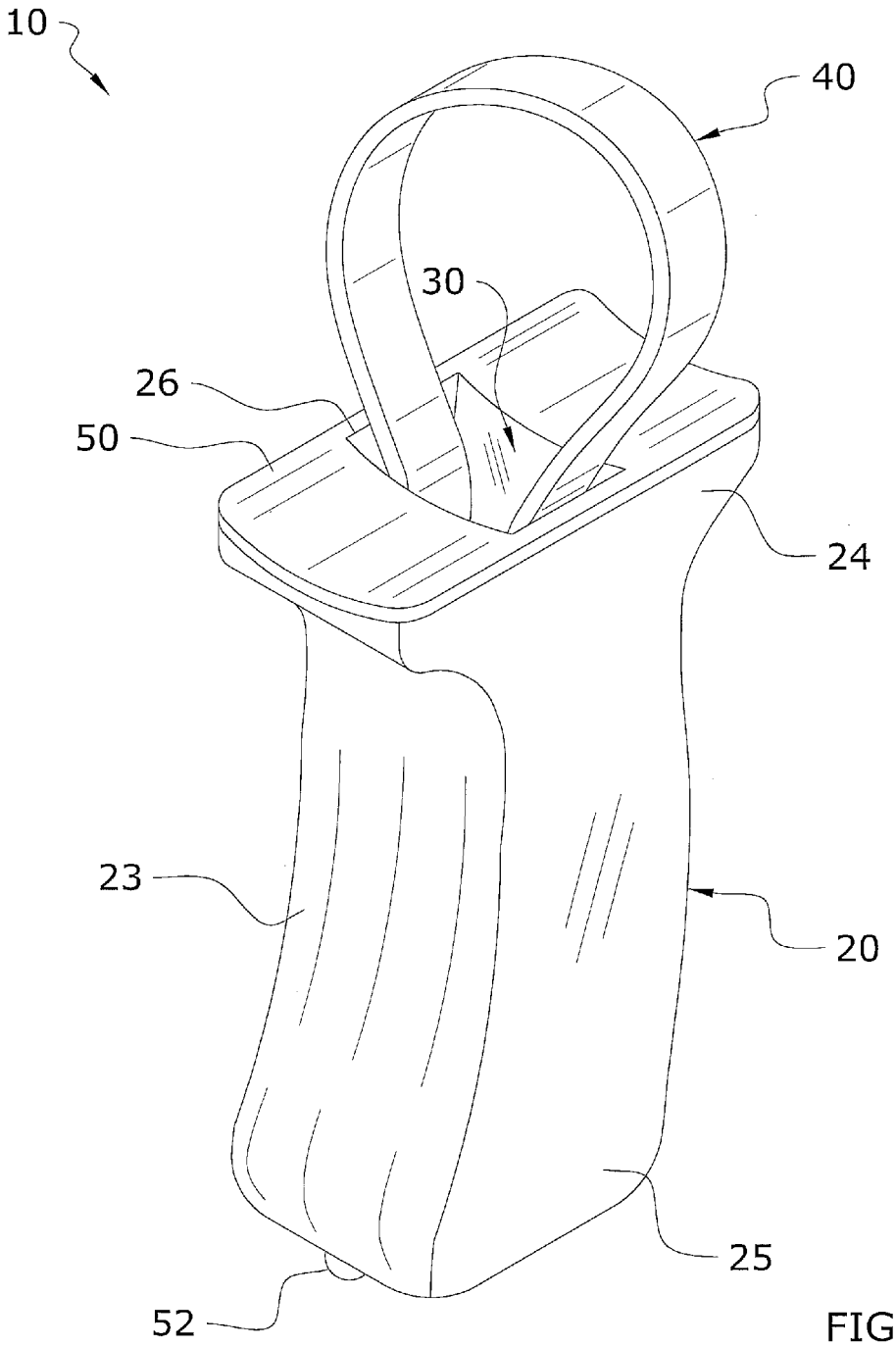
FIG. 1 is an upper perspective view of the present invention.

Turning now descriptively to the drawings, in which similar reference characters denote similar elements throughout the several views, FIGS. 1 through 8 illustrate an adjustable firearm grip 10, which comprises a handgrip 20 including an upper opening 26 and a lower opening 27. A passageway 30 extends from the upper opening 26 to the lower opening 27 and includes a connector 46 slidably positioned therein. A strap 40 is provided for extending around a firearm 12, wherein both ends 42, 43 of the strap 40 are each connected to the connector 46 and the strap 40 extends upwardly from the upper opening 26 of the handgrip 20. A strap bolt 48 and adjustment knob 49 are threadably attached to the connector 46. The adjustable firearm grip 10 may be attached to a firearm 12 by placing the strap 40 around the firearm's barrel 14 at any location and then turning the adjustment knob 49 to tighten the strap 40 for a firm fit.

B. Handgrip

Figure 2:
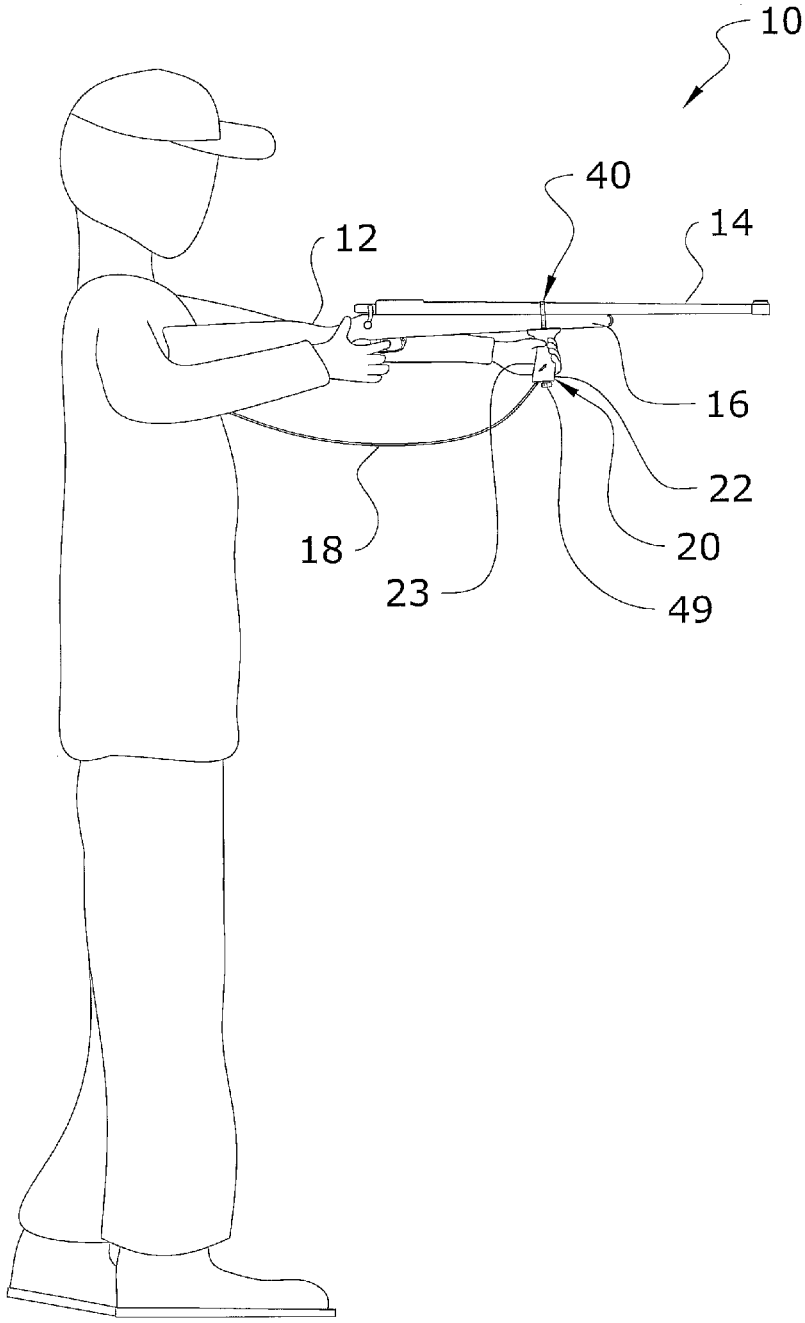
FIG. 2 is a side view of the present invention attached to a firearm which is being operated by an individual.

The present invention generally includes a handgrip 20 having a front side 22 and a rear side 23. The handgrip 20 is the portion of the present invention which acts as an additional handgrip or should rest when installed on a firearm 12 as illustrated in FIG. 2. The handgrip 20 is generally shaped similar to a convention handgrip as would be seen on a handgun.

The front side 22 of the handgrip 20 will generally be outwardly curved so as to match the contours of the user's fingers when the handgrip 20 is gripped. The front side 22 of the handgrip 20 may also include indentations thereon for accommodating the individual fingers of a user's hand. The rear side 23 of the handgrip 20 will generally be inwardly curved so as to allow a firm grip for the palm of the user's hand when the present invention is in use. The inward curve of the rear side 23 of the handgrip 20 is also preferable so as to allow the handgrip 20 to stay better secured when draped over the shoulder of a user of the present invention.

The handgrip 20 may be comprised of various materials including plastics, metals and/or woods. The handgrip 20 is preferably comprised of a durable wood material so as to substantially match the firearm stock 16. The handgrip 20 will preferably have a finished appearance and be largely resistant to scratches or other defects caused by the day-to-day use of the present invention.

Figure 5:
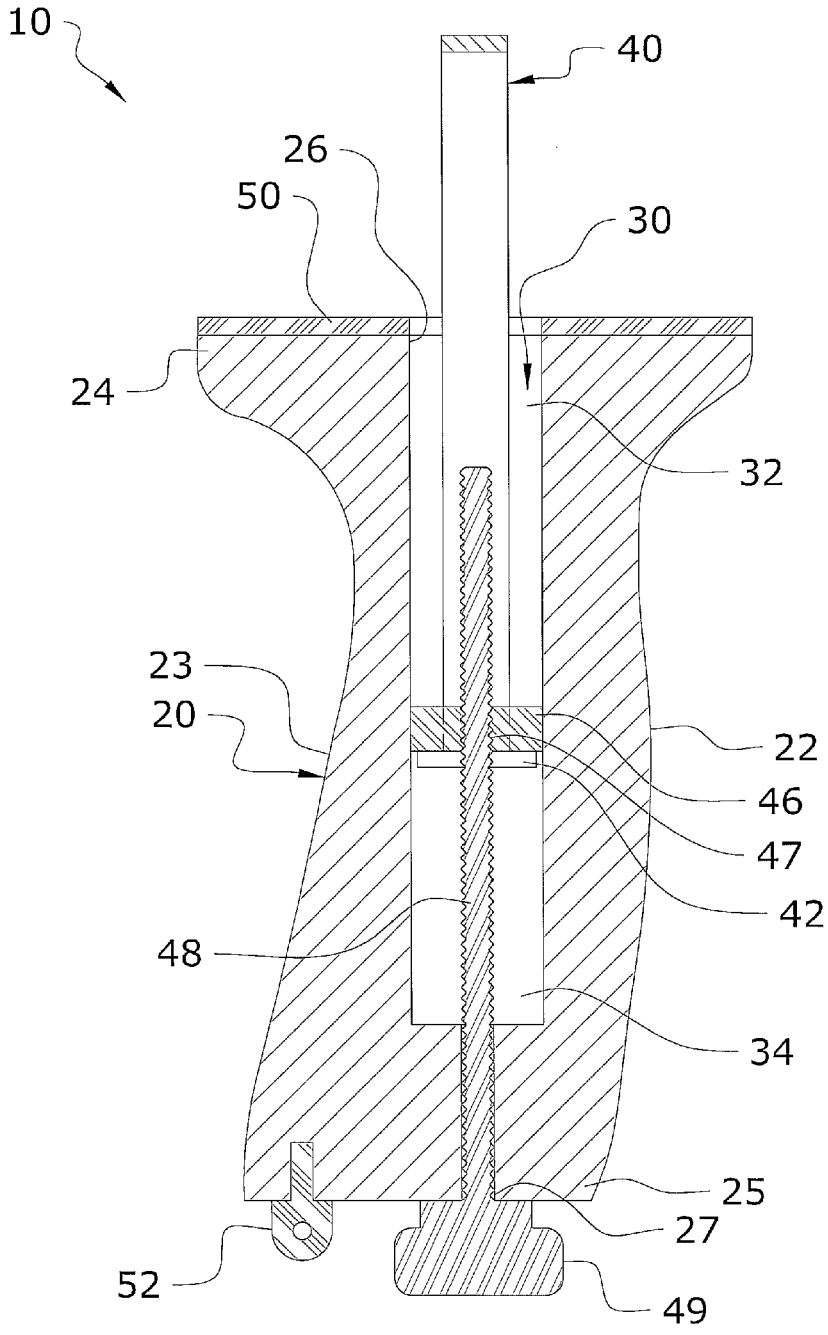
FIG. 5 is a side cutaway view of the present invention.

The handgrip 20 of the present invention will generally include both and upper end 24 and a lower end 25. As shown in FIG. 5, the upper end 24 of the handgrip 20 generally includes an upper opening 26 from which a strap 40 may be extended as discussed below. The upper opening 26 may be of various cross-sections and sizes, though it is preferable that the upper opening 26 have a substantially rectangular cross-section and be of sufficient size so as to better accommodate the strap 40 of the present invention.

The upper end 24 of the handgrip 20 may also include a protective membrane 50 as illustrated in FIG. 1. The protective membrane 50 will generally cover the entire upper end 24 of the handgrip 20 with the exception of the upper opening 26. The protective membrane 50 generally serves to protect the firearm 12 from being damaged, scuffed or scratched from the adjustable firearm grip 10 when it is installed thereon. The protective membrane 50 may be comprised of various flexible, soft materials. In a preferred embodiment, the protective membrane 50 is comprised of a rubber material.

The lower end 25 of the handgrip 20 generally includes a lower opening 27 from which an adjustment knob 49 may be extended. The lower opening 27 may be of various cross-sections and sizes, though it is preferable that the lower opening 27 have a substantially circular cross-section and be of only slightly larger diameter than that of the adjustment knob 49 so that the adjustment knob 49 may be firmly fit therein.

The lower end 25 of the handgrip 20 may also include a sling stud 52 attached thereto. The sling stud 52 will generally be comprised of a downwardly facing bolt or other structure with a hole extending therethrough for insertion of a firearm sling 18 as shown in FIG. 5. Although the sling stud 52 is shown as being a separate structure from the handgrip 20, it is appreciated that the sling stud 52 and handgrip 20 may be integrally formed in some embodiments.

C. Passageway

Figure 6:
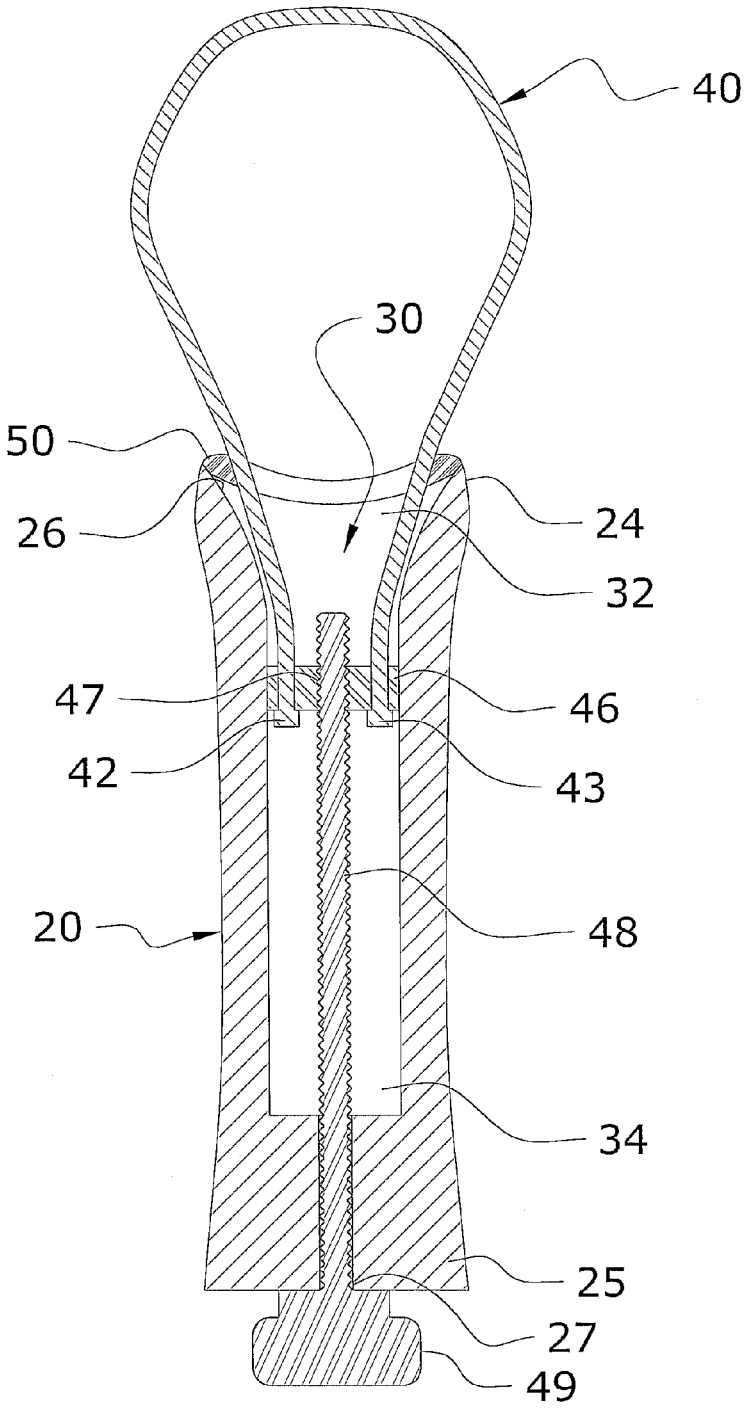
FIG. 6 is a front cutaway view of the present invention.

A passageway 30 generally extends vertically through the entire handgrip 20 from its upper opening 26 on its upper end 24 to its lower opening 27 on its lower end 25. The passageway 30 will act as a space for accommodating the strap 40, connector 46, strap bolt 48 and adjustment knob 49 as shown in FIG. 6.

The passageway 30 may be comprised of a single diameter and cross-section throughout, but it is preferable that the passageway 30 be comprised of an upper portion 32 having a first diameter and cross-section and a lower portion 34 having a second diameter and cross-section. In a preferred embodiment, the upper portion 32 of the passageway 30 will be comprised of a substantially rectangular cross-section and a larger diameter than that of the lower portion 34. Additionally, it is preferred that the upper portion 32 of the passageway 30 gradually widens for the top 20% of its length so as to allow the strap 40 to slightly widen before exiting the upper opening 26 of the handgrip as shown in FIG. 5.

The lower portion 34 of the passageway 30 will generally be comprised of circular cross-section and a diameter which is only slightly larger than that of the strap bolt 48 of the present invention. Such a configuration is preferably so as to allow the strap bolt 48 to be firmly held within the passageway 30 without wiggling or coming loose. Although the lower portion 34 of the passageway 30 is shown to be of substantially less length than that of the upper portion 32 in the figures, it is appreciated that both the upper portion 32 and lower portion 34 of the passageway 30 may be of various lengths so long as sufficient length is provided in the upper portion 32 to allow the strap 40 to be adjustable to accommodate a wide variety of barrel 14 sizes.

D. Strap

The adjustable firearm grip 10 will generally include a strap 40 for extending around a firearm 12 as shown in FIG. 2. The strap 40 of the present invention may be comprised of various flexible, elongated materials including cloth, nylon, leather and the like. It is preferred that the strap 40 be durable enough to withstand elements such as extreme cold, heat and rain. It is also preferred that the strap 40 be of sufficient strength to firmly attach the adjustable firearm grip 10 to the firearm 12 so as to prevent the handgrip 20 from coming loose during use in the field.

The strap 40 will generally include both a first end 42 and a second end 43. Both the first end 42 and second end 43 of the strap 40 will generally be connected to a connector 46 as illustrated in FIG. 6. The connector 46 serves as an anchor for the first end 42 and second end 43 of the strap 40. The respective ends of the strap 40 may be connected to the connector 46 by various connecting means, so long as the first end 42 and second end 43 of the strap are firmly connected thereon in a manner that will prevent dislodging or loosening of the connection through repeated use.

The connector 46 is generally comprised of a durable piece of wood, metal or the like which is slidably attached within the upper portion 32 of the passageway 30. In a preferred embodiment, the connector 46 is comprised of a standard, rectangular nut onto which the first end 42 and second end 43 of the strap will be attached.

The connector 46 acts to adjust the size of the strap 40 portion which extends upwardly from the upper opening 26 by sliding up and down within the passageway in response to the turning of the adjustment knob 49. The connector 46 will preferably be comprised of a rectangular shape to match the rectangular cross-section of the upper portion 32 of the passageway 30, but it is appreciated that the connector 46 may be comprised of various shapes to match alternate passageway 30 cross-sections so long as the connector 46 is capable of sliding freely within the passageway 30 when the strap 40 is being adjusted.

The connector 46 will generally include at least one threaded aperture 47 through which a strap bolt 48 is threadably extended. The aperture 47 will generally be of a circular cross-section, though it is appreciated that various other cross-sections may be utilized to accommodate different types of strap bolts 48. The interior surfaces of the aperture 47 will generally be threaded so as to counteract with the threading on the outer surfaces of the strap bolt 48.

The strap bolt 48 of the present invention is generally comprised of an elongated, rigid member with external threading. In a preferred embodiment, the strap bolt 48 is comprised of a cylindrical, threaded fastener which extends vertically through both the lower portion 34 and upper portion 32 of the passageway 30 as shown in FIG. 6. Although the strap bolt 48 is shown as being comprised of a length which does not extend for the entire passageway 30, it is appreciated that the strap bolt 48 may be of various lengths and, in some embodiments, may extend through the entire passageway 30.

The strap bolt 48 will generally include an adjustment knob 49 attached to its lower end as shown in FIG. 5. However, it is appreciated that the adjustment knob 49 and strap bolt 48 may be integrally formed in some embodiments of the present invention. The adjustment knob 49 is generally comprised of a bulbous handle which extends downwardly and outwardly from the lower opening 27 of the handgrip 20. The adjustment knob 49 may be of various shapes and sizes so long as it may be firmly gripped and turned by a user of the present invention. It is also preferable that the adjustment knob 49 be durable enough to withstand the rigors of daily use and avoid becoming loosened or damaged in the field.

E. Operation of Preferred Embodiment

Figure 3:
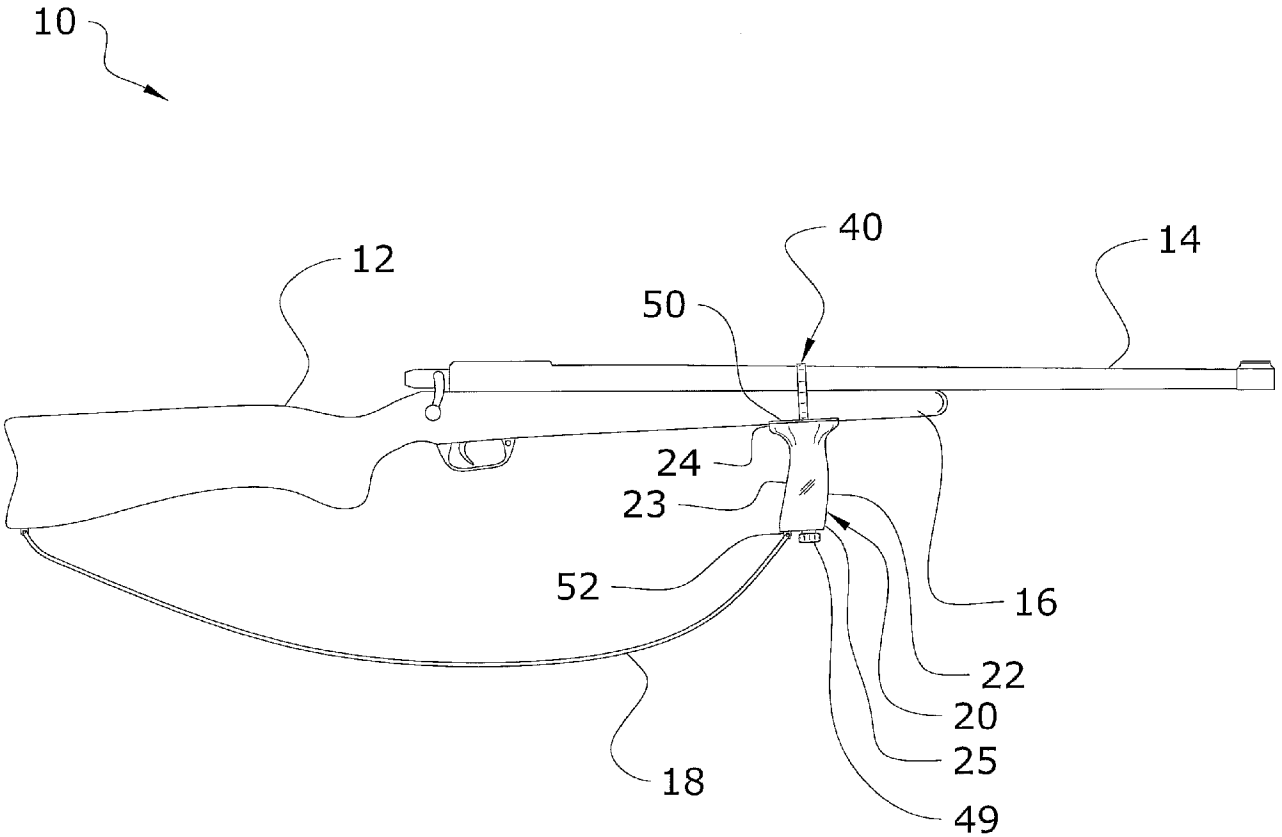
FIG. 3 is a side view of the present invention attached to a firearm.
Figure 4:
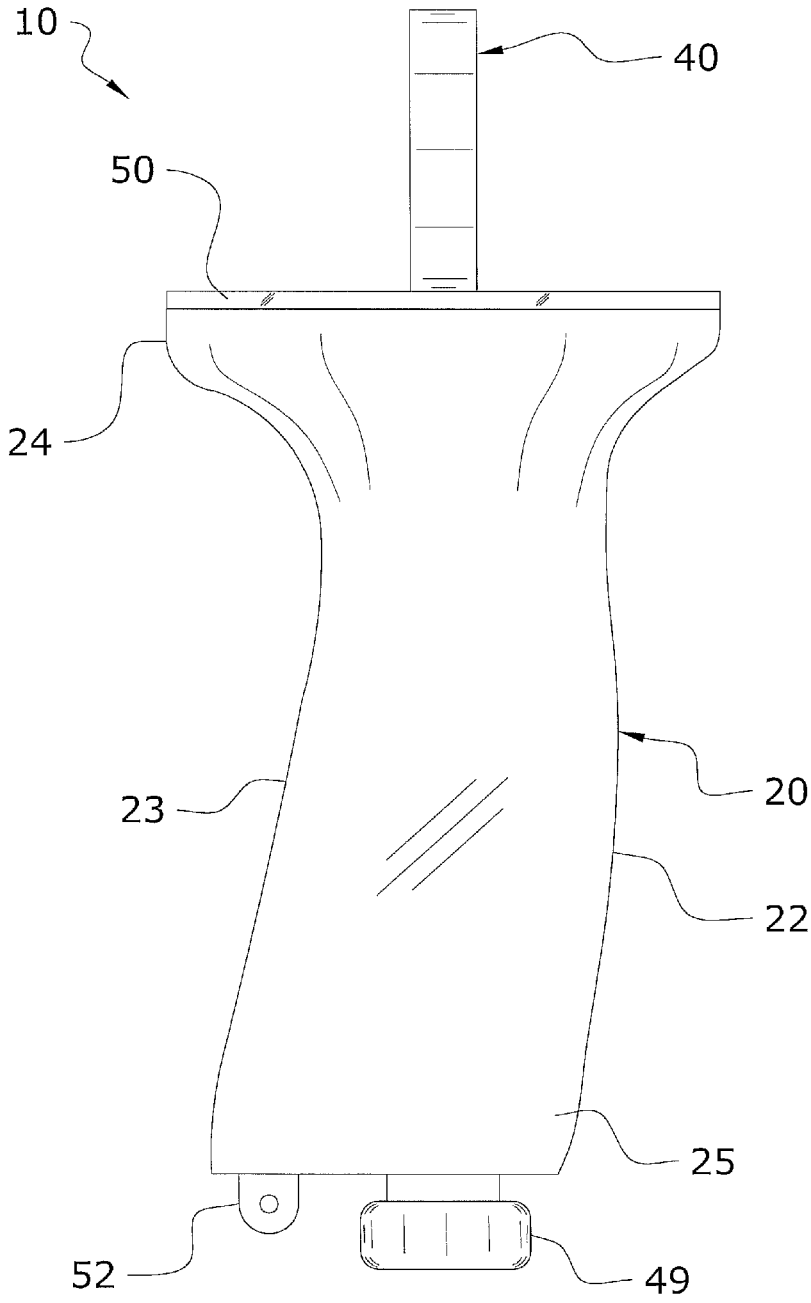
FIG. 4 is a side view of the present invention.
Figure 7:
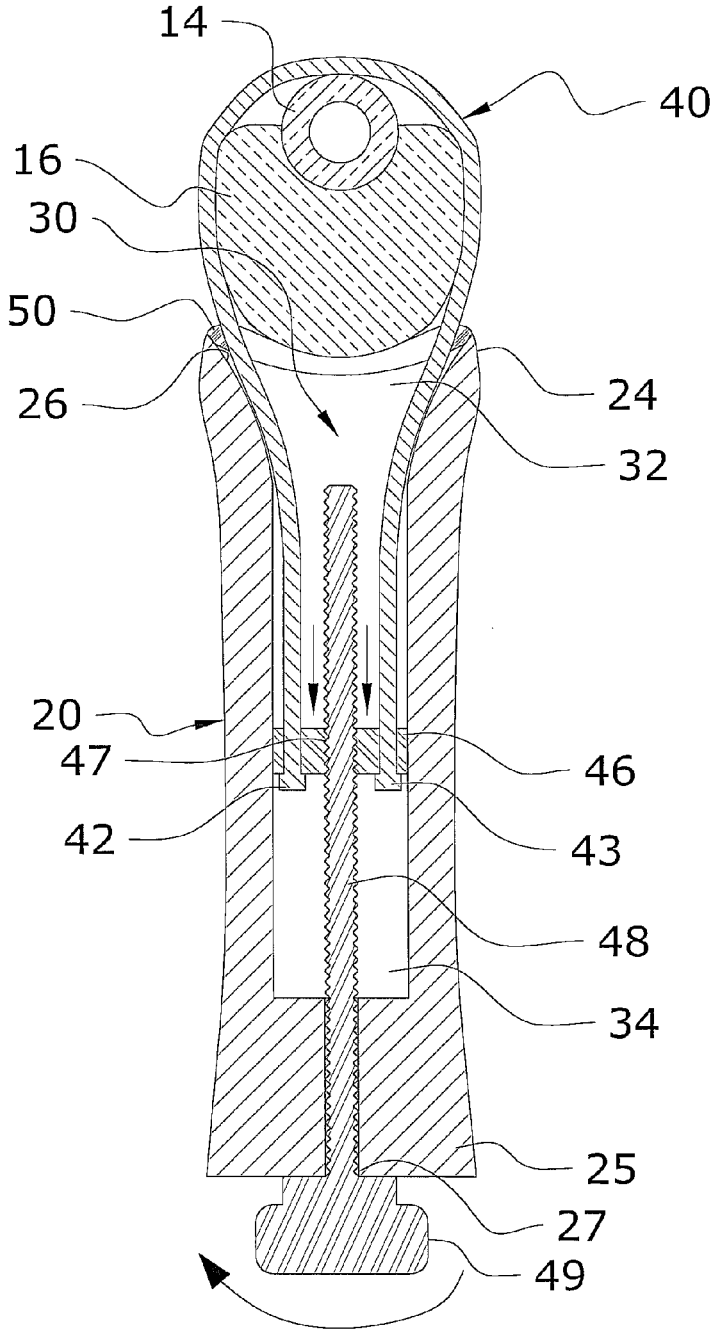
FIG. 7 is a front cutaway view of the present invention attached to a firearm.
Figure 8:
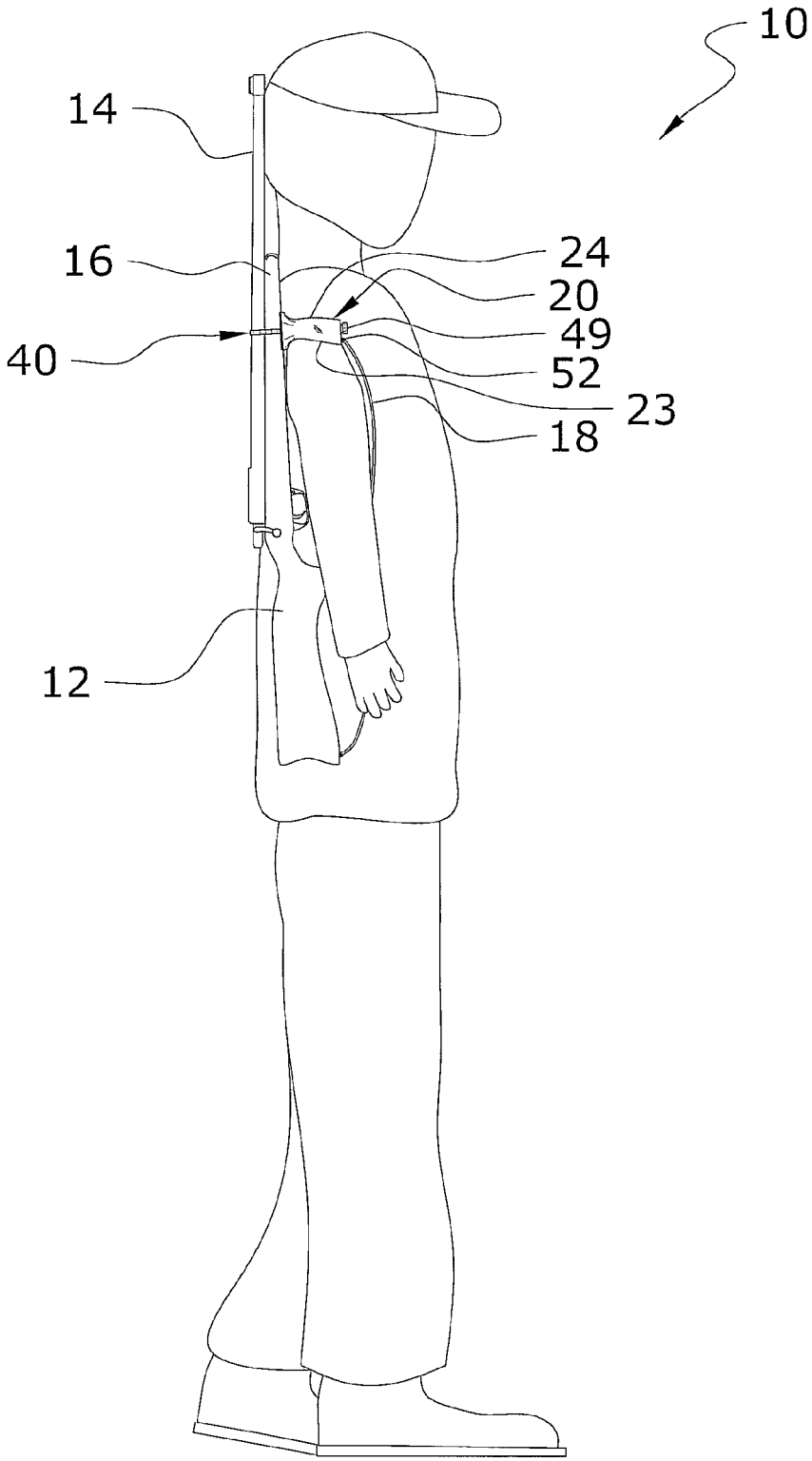
FIG. 8 is a side view of the present invention in use on a firearm being carried by an individual.

In use, the strap 40 is loosened by turning the adjustment knob 49 in a first direction as shown in FIG. 7. The strap 40 is then extended around the barrel 14 of a firearm 12 at a location which will be most comfortable for the user to grip. The strap 40 may then be tightened around the barrel 14 of the firearm 12 by turning the adjustment knob 49 in a second direction. The turning of the adjustment knob 49 will cause the connector 46 to move downward, thus pulling the first end 42 and second end 43 of the strap 40 further into the passageway 30 and tightening the strap 40. The adjustable firearm grip 10 may then be gripped by a user for additional stability when shooting as shown in FIG. 2 or placed on the user's shoulder for hoisting the firearm 12 when not in use as shown in FIG. 8. A firearm sling 18 may also be attached to the sling stud 52 so as to create a sling between the firearm stock 16 and adjustable firearm grip 10 as shown in FIG. 3.

When the user has finished using the adjustable firearm grip 10, it may be removed by turning the adjustment knob 49 in a second direction, which will cause the connector 46 to move upward, thus pushing the first end 42 and second end 43 of the strap 40 upward and loosening the strap 40.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An adjustable firearm grip, comprising:

a handgrip including an upper opening and a lower opening;

a passageway extending from said upper opening to said lower opening;

a strap bolt extending within said passageway;

a connector threadably attached to said strap bolt, wherein said connector is slidably positioned within said passageway, wherein said connector includes an aperture, wherein said strap bolt threadably extends through said aperture;

wherein said connector is movable relative to said strap bolt;

a strap for extending around a firearm, wherein a first end of said strap and a second end of said strap are each connected to said connector, wherein said strap extends upwardly from said upper opening of said handgrip;

an adjustment knob attached to said strap bolt; and wherein the application of turning force to said adjustment knob in a first direction causes said strap to tighten, wherein the application of turning force to said adjustment knob in a second direction causes said strap to loosen.

2. The adjustable firearm grip of claim 1, wherein said handgrip includes a front side and a rear side, wherein said front side of said handgrip includes a curved surface.

3. The adjustable firearm grip of claim 1, wherein said passageway includes an upper portion and a lower portion, wherein the width of said upper portion is greater than that of said lower portion.

4. The adjustable firearm grip of claim 3, wherein said upper portion of said passageway is comprised of a rectangular cross section.

5. The adjustable firearm grip of claim 4, wherein said lower portion of said passageway is comprised of a circular cross section.

6. The adjustable firearm grip of claim 5, wherein the vertical length of said upper portion of said passageway is substantially longer than that of said lower portion of said passageway.

7. The adjustable firearm grip of claim 1, wherein said handgrip includes an upper end and a lower end, wherein said upper end of said handgrip includes a protective membrane attached thereon.

8. The adjustable firearm grip of claim 7, wherein said protective membrane is comprised of a rubber material.

9. The adjustable firearm grip of claim 7, wherein said lower end of said handgrip includes a sling stud.

10. The adjustable firearm grip of claim 1, wherein said adjustment knob extends downwardly from said lower opening of said handgrip.

11. An adjustable firearm grip, comprising:

a firearm including a barrel and a stock;

a handgrip removably attached to said firearm, wherein said handgrip is positioned adjacent to said stock, wherein said handgrip includes an upper end and a lower end, wherein said upper end of said handgrip includes an upper opening, wherein said lower end of said handgrip includes a lower opening;

a protective membrane attached to said upper end of said handgrip;

a passageway extending from said upper opening to said lower opening;

a strap bolt extending within said passageway;

a connector threadably attached to said strap bolt, wherein said connector is slidably positioned within said passageway, wherein said connector includes an aperture, wherein said strap bolt threadably extends through said aperture;

wherein said connector is movable relative to said strap bolt;

a strap for extending around a firearm, wherein a first end of said strap and a second end of said strap are each connected to said connector, wherein said strap extends upwardly from said upper opening of said handgrip, wherein said strap extends around said barrel and said stock;

an adjustment knob attached to said strap bolt, wherein said adjustment knob extends downwardly from said lower opening of said handgrip;

a sling stud attached to said lower end of said handgrip; and wherein the application of turning force to said adjustment knob in a first direction causes said strap to tighten;

wherein the application of turning force to said adjustment knob in a second direction causes said strap to loosen.

12. The adjustable firearm grip of claim 11, wherein said handgrip includes a front side and a rear side, wherein said front side of said handgrip includes an outwardly curved surface.

13. The adjustable firearm grip of claim 12, wherein said rear side of said handgrip includes an inwardly curved surface.

14. The adjustable firearm grip of claim 11, wherein said passageway includes an upper portion and a lower portion, wherein the width of said upper portion is greater than that of said lower portion.

15. The adjustable firearm grip of claim 14, wherein said upper portion of said passageway is comprised of a rectangular cross section.

16. The adjustable firearm grip of claim 15, wherein said lower portion of said passageway is comprised of a circular cross section.

17. The adjustable firearm grip of claim 16, wherein the vertical length of said upper portion of said passageway is substantially longer than that of said lower portion of said passageway.

18. The adjustable firearm grip of claim 11, wherein said protective membrane is comprised of a rubber material.

19. An adjustable firearm gripping system, comprising:

a firearm including a barrel and a firearm stock, wherein a first end of a firearm sling is removably attached to said firearm stock;

a handgrip including an upper end and a lower end, wherein said upper end of said handgrip includes an upper opening, wherein said lower end of said handgrip includes a lower opening;

wherein said handgrip includes a front side and a rear side, wherein said front side of said handgrip includes an outwardly curved surface, wherein said rear side of said handgrip includes an inwardly curved surface;

a passageway extending from said upper opening to said lower opening, wherein said passageway includes an upper portion and a lower portion, wherein the width of said upper portion is greater than that of said lower portion, wherein the vertical length of said upper portion of said passageway is substantially longer than that of said lower portion of said passageway;

wherein said upper portion is comprised of a substantially rectangular cross section, wherein said lower portion is comprised of a substantially circular cross section;

a strap bolt extending within said passageway;

a connector threadably attached to said strap bolt, wherein said connector is slidably positioned within said passageway, wherein said connector includes an aperture, wherein said strap bolt threadably extends through said aperture;

wherein said connector is movable relative to said strap bolt;

a strap for extending around a firearm, wherein a first end of said strap and a second end of said strap are each connected to said connector, wherein said strap extends upwardly from said upper opening of said handgrip, wherein said barrel of said firearm is inserted through said strap;

an adjustment knob attached to said strap bolt, wherein said adjustment knob extends downwardly from said lower opening of said handgrip;

a sling stud attached to said lower end of said handgrip, wherein a second end of said firearm sling is removably attached to said sling stud;

a protective membrane covering said upper end of said handgrip, wherein said protective membrane is comprised of a rubber material; and wherein the application of turning force to said adjustment knob in a first direction causes said strap to tighten around said barrel of said handgun;

wherein the application of turning force to said adjustment knob in a second direction causes said strap to loosen around said barrel of said handgun.

* * * * *